United States Patent [19]

Tanner

[11] Patent Number: 4,476,988

[45] Date of Patent: Oct. 16, 1984

[54] STORAGE AND TRANSPORT CONTAINERS

[75] Inventor: Nicholas J. Tanner, Poole, England

[73] Assignee: Wes Ltd., Parkstone, United Kingdom

[21] Appl. No.: 477,427

[22] Filed: Mar. 21, 1983

Related U.S. Application Data

[63] Continuation-in-part of Ser. No. 187,999, Sep. 17, 1980, abandoned.

[30] Foreign Application Priority Data

Sep. 20, 1979 [GB] United Kingdom ..... 7932572
Jun. 13, 1980 [GB] United Kingdom ..... 8019371

[51] Int. Cl.[3] ..... B65D 6/34; B65D 57/00; B65D 88/10; F42B 37/02

[52] U.S. Cl. ..... 220/1.5; 49/345; 49/379; 49/386; 206/3; 206/443; 220/21; 220/71; 220/72.1; 292/148; 292/175

[58] Field of Search ..... 220/1.5, 21, 70.1, 72.1, 220/71, 85 R, 401, 84; 206/3, 521, 443, 585, 586, 589; 49/65, 67, 386, 379, 345, 324; 292/42, 175, 145, 162, 148, DIG. 72; 217/21, 22, 23

[56] References Cited

U.S. PATENT DOCUMENTS

| | | | |
|---|---|---|---|
| 142,952 | 9/1873 | Simmons | 217/23 |
| 808,854 | 1/1906 | Mayer | 206/3 |
| 1,000,636 | 8/1911 | Steel | 220/71 X |
| 1,314,445 | 8/1919 | Wacker | 220/71 |
| 2,477,831 | 8/1944 | Schmitz, Jr. | 220/71 X |
| 2,676,729 | 4/1954 | Neville, Jr. et al. | 220/71 |
| 2,757,554 | 8/1956 | Niedhammer | 49/345 X |
| 2,792,962 | 5/1957 | Granfelt | 206/3 X |
| 2,909,254 | 10/1959 | Hallock | 49/386 |
| 2,936,189 | 5/1960 | Pearson | 292/42 |
| 3,465,871 | 9/1969 | Lyonset et al. | 206/3 |
| 3,655,229 | 4/1972 | Tumbiolo | 292/148 |

FOREIGN PATENT DOCUMENTS

| | | | |
|---|---|---|---|
| 241329 | 7/1965 | Austria | 220/21 |
| 14903 | 10/1955 | Fed. Rep. of Germany | 220/71 |
| 500215 | 3/1920 | France | 49/345 |
| 815792 | 7/1937 | France | 206/3 |
| 29611 | 3/1977 | Japan | 220/71 |
| 1598 | 12/1915 | United Kingdom | 217/22 |
| 2058720 | 4/1981 | United Kingdom | 206/3 |

*Primary Examiner*—Allan N. Shoop
*Attorney, Agent, or Firm*—Charles E. Temko

[57] ABSTRACT

A five sided steel box with a honeycomb member therein formed by corrugated sheets and defining a plurality of hexagonal elongate recesses. Spacers on the outer faces of the walls of the box have tie bars secured transversely thereto and the ends of the bars are welded to protective hoops. A door closes and seals the box and comprises a framework, a panel mounted on the framework by means of clamping screws or parallelogram linkage and coil springs, and a seal between the panel and the open side of the box. The framework is preferably hinged to protective hoops of the box at one side and provided with a latch arrangement at the other.

10 Claims, 13 Drawing Figures

FIG. 1
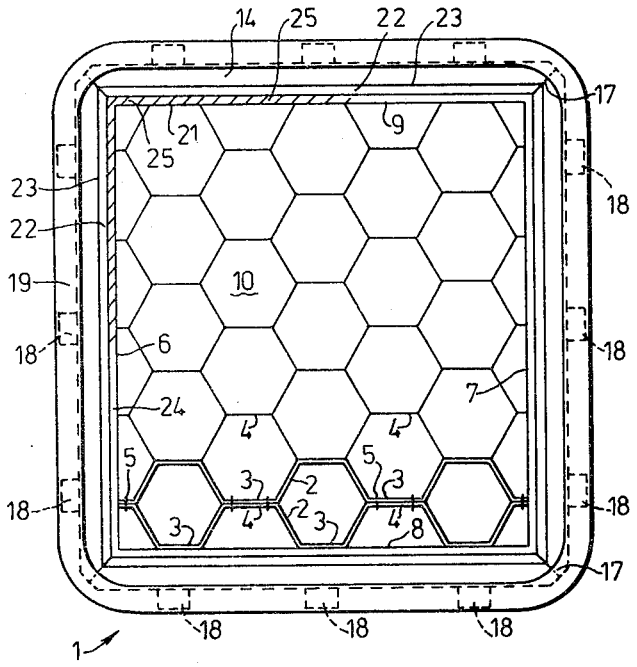
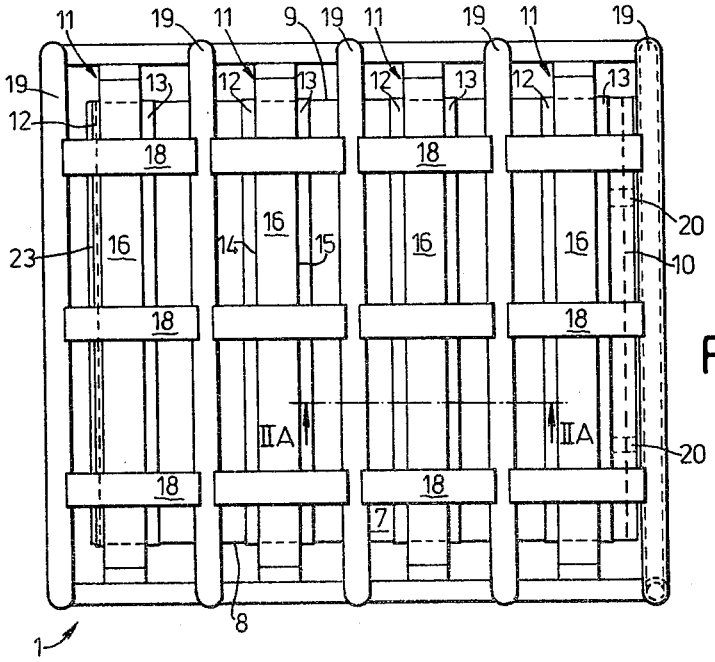
FIG. 2

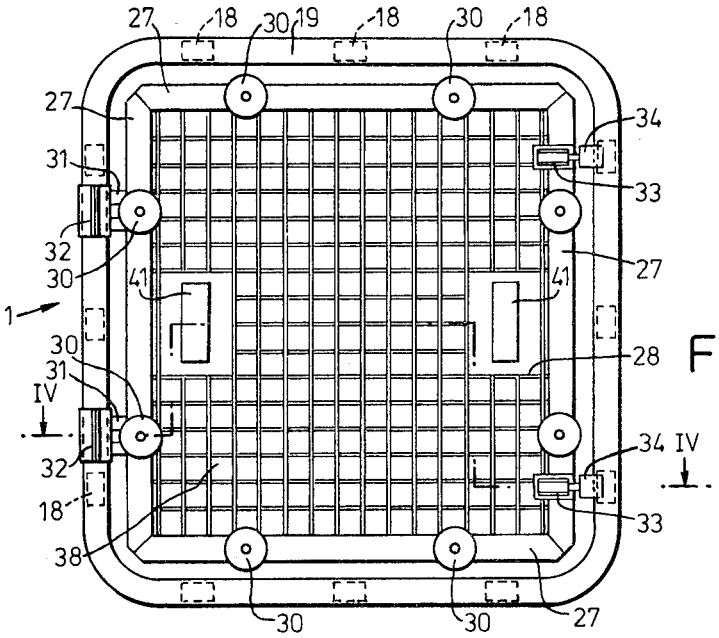
FIG. 3
FIG. 7
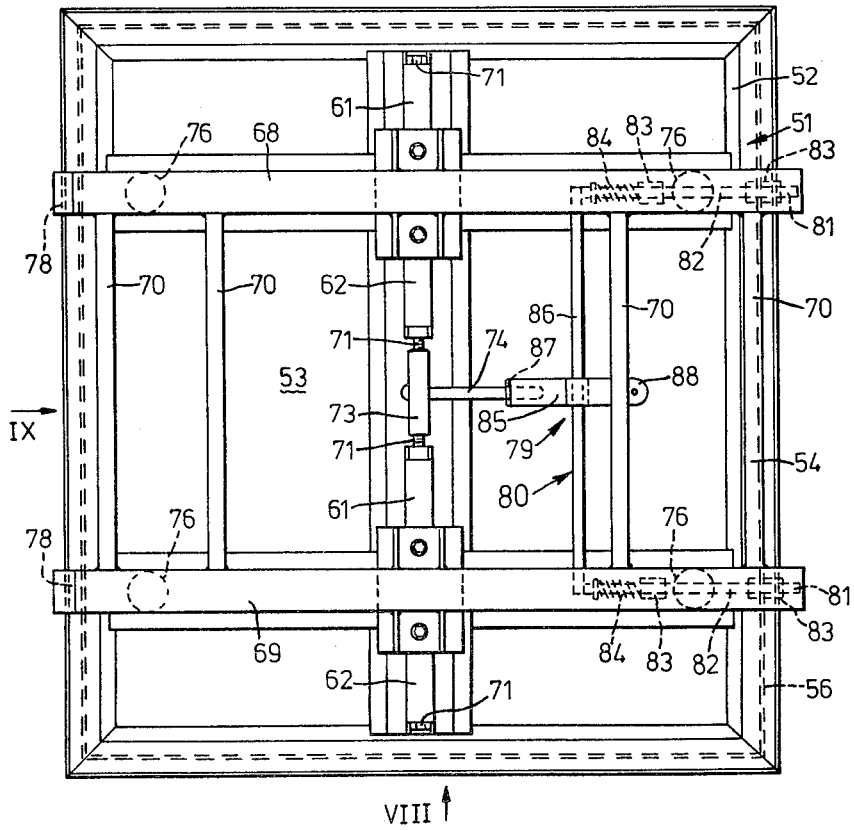

STORAGE AND TRANSPORT CONTAINERS

RELATED APPLICATION

This application is a continuation in part of application Ser. No. 187,999, filed Sept. 17, 1980, now abandoned.

BACKGROUND OF THE INVENTION

The invention relates to storage and transport containers for elongate articles and has particular though not exclusive application to the storage and transport of ammunition of the size and kind used in military tanks. Each shell of such ammunition may for example be in the region of fourteen centimeters in diameter, ninety centimeters in length and weigh twenty kilograms. One method previously used of storing and transporting such ammunition was to contain each separate shell in an hermetically sealed container, provide a plurality of tubes in a steel box and slide each shell into a respective one of the tubes, the box then being mounted on a pallet for handling by forklift trucks and loading into a logistics vehicle for transportation to the site at which a tank was to be armed, the individual shells then being extracted in their containers from the tubes, stripped of their containers and loaded into the tank. The containers were liable to damage such that they could frequently not be reused and there was considerable wasted space in the box formed by dead space between the tubes which could not nestle closely together.

Where a container is to be used to store articles for a considerable period, for example fifteen years, it is frequently important that it be hermetically sealed to prevent deterioration of the articles due to atmospheric corrosion. Hermetically sealing a container with a large opening, for example one and one-half meters square in a manner such that the container can be transported without breaking the seal, presents considerable problems.

SUMMARY OF THE INVENTION

According to the invention there is provided a storage and transport container for elongate articles comprising a member of generally honeycomb section defining a plurality of elongate recesses, a five sided box surrounding said member of honeycomb section, spacer members secured to the outer faces of the walls of the box, protective hoops encircling the box and secured to said spacer members and a door to close and seal the open side of said box.

Advantageously, the member of honeycomb section is formed as a stack of corrugated sheets, said sheets being superposed with their corrugations offset and secured together. Advantageously the protective hoops are secured to the spacer members by way of tie bars which extend between adjacent pairs of said hoops and are secured to said hoops and to said spacer members.

Preferably the corrugated sheets of the stack, the walls of the box and the spacer members are all formed of sheet steel. The corrugated sheets are preferably so shaped that the elongate recesses, each formed between two cooperating sheets of the stack of sheets, are of hexagonal section. The sheets of the stack are spot-welded together as the stack is built up and the walls of the box are spot-welded to sheets of the stack and are seam welded to each other. The hoops and the tie bars are preferably formed of tubular steel, the hoops of circular section and the tie bars of rectangular section.

The spacers are advantageously elongate members each of top hat section with the two flanges forming the brim of the top hat section spot-welded to the walls of the box. The elongate spacer members encircle the box so that they extend parallel to the hoops with each spacer member located intermediate an adjacent pair of the hoops. The tie bars extend perpendicular to the elongate spacers and to the hoops with the middle portion of each tie bar lying on and welded to the web of the respective top hat section spacer member forming the crown thereof and with its ends welded to respective ones of the two adjacent ones of the hoops.

End ones of the hoops extend at positions clear of the ends of the box and on the single end wall of the box further spacer members are provided to reinforce said end wall.

The door may comprise a surrounding frame, a wire mesh sheet at the inner side of said frame and a glass reinforced plastics cover which engages a seal provided between the cover and the box at the open side thereof. Preferably the frame of the door at one of its sides is pivotally mounted on an end one of the hoops and at a side opposite to said one side is provided with securing means. Clamp screws are preferably provided, screw threadedly engaged in apertures in the frame of the door and engaging the plastics cover at a plurality of positions around its periphery to press the plastics cover away from the frame and into engagement with the seal.

Alternatively the door may comprise a panel with sealing means at or adjacent its periphery to engage the box at or adjacent the open side thereof, a framework located on the exterior face of the panel, at least one parallelogram linkage located between and connecting the panel and the framework and a plurality of compression springs extending between the panel and the framework, the framework being engageable at opposite sides thereof with the box such that the force of the springs presses the panel away from the framework towards the box to seal the panel around the open side of the box, which force can be overcome by tensioning the linkage to pull the panel outwardly towards the framework.

Preferably the linkage is provided as a pair of linkages with a common operating member.

Advantageously the framework is engageable with the box at one side by means of hinge pins and at the opposite side by means of a latch arrangement. The latch arrangement and the common operating member of the linkages can be engaged one with the other and secured, for example by means of a padlock, to prevent unauthorized opening of the container.

BRIEF DESCRIPTION OF THE DRAWING

In the drawing, to which reference will be made in the specification;

FIG. 1 is an elevation of the open end of a storage and transport container for elongate articles according to the invention;

FIG. 2 is a side view corresponding to FIG. 1;

FIG. 3 is a view similar to FIG. 1 but with a lid in position on the container;

FIG. 7 is an elevation of a door to close an opening of a container according to the invention and forming an alternative embodiment to the lid of FIGS. 3 and 4;

DETAILED DESCRIPTION OF THE DISCLOSED EMBODIMENT

Figure 2A:
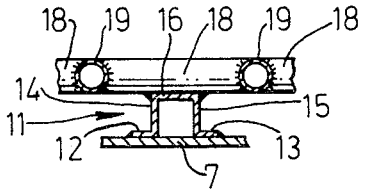
FIG. 2A is a cross sectional view of a portion of the end of the container of FIG. 2 in the direction of arrows IIA—IIA.

Referring to the drawings and firstly to FIGS. 1 and 2, a storage and transport container for elongate articles, generally indicated at 1, comprises a stack of ten corrugated sheets 2, the thicknesses of which are indicated only at the bottom of FIG. 1, each comprising alternate angular depressions 3 and raised portions 4 such that with alternate sheets inverted a honeycomb section defining hexagonal elongate recesses is formed, the sheets being spot-welded together as indicated at 5. The stack of ten sheets 2 secured together provide twenty three elongate recesses of hexagonal section, two half hexagonal recesses at the top and at the bottom and a plurality of smaller recesses at the sides. The smaller recesses can be used to receive bags of silica gel or similar hydroscopic material.

A five sided box of sheet steel is formed around the stack of corrugated sheets 2 and comprises opposite side walls 6 and 7, a lower wall 8 and an upper wall 9. A rear wall 10 is also provided, the walls 6, 7, 8, 9, and 10 being secured to the corrugated sheets 2 by spot-welding and being seam welded where they abut one with another. Spacers 11 are secured along the walls 6, 7, 8, and 9 extending in parallel to the free edges thereof. Four spacers 11 are provided on each of the walls 6, 7, 8, and 9 and each spacer 11 is of top hat section comprising base or brim flanges 12 and 13, side flanges 14 and 15 and a crown flange 16. The ends of the spacers 11 are mitred to join with the aligned spacer on the adjacent faces of the box at joint lines 17.

Tie bars 18 of rectangular section steel tubing are laid across the crown flanges 16 of the spacers 11 and at their ends abut hoops 19 which are provided of circular section steel tube and each completely encircle the box. Five hoops 19 are provided. The ends of the tie bars 18 are welded to the hoops 19 and the tie bars 18 are welded to the crown flanges 16 of the spacers 11. The hoop 19 at the front of the box and the hoop 19 at the rear of the box are provided at positions beyond the front end and rear end respectively.

At the rear of the box on the rear wall 10, stiffeners 20 are provided of similar section to the spacers 11 and welded to the wall 10.

Figure 4:
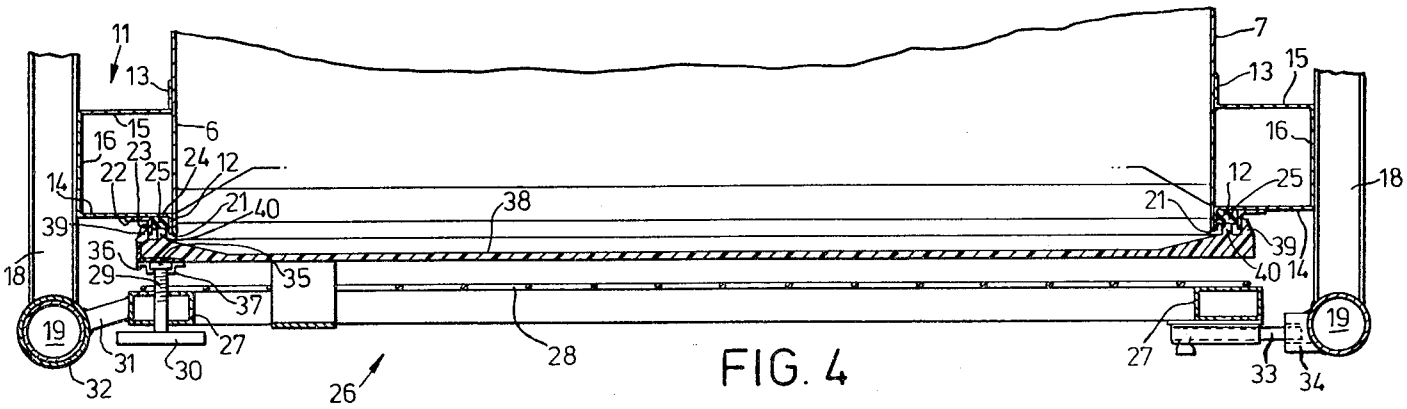
FIG. 4 is a sectional view taken on line IV—IV of FIG. 3 showing the lid.

Referring now to FIGS. 3 and 4 in addition to FIGS. 1 and 2, at the front of the box the flange 12 of the spacer 11 adjacent the free edge of the box on each of the four sides is shortened and secured to the adjacent walls 6, 7, 8, or 9, by fusion welding at position 21 all round the box. An angular section bracket 22 is welded to the adjacent side flanges 14 of the four spacers 11 at the front of the box to form between a flange 23 of the bracket 22 and the shortened base flange 12 of the adjacent spacer 11 a trough 24 in which a sealing strip 25 is received.

A door 26 comprises an outer framework formed by four rectangular section tubular side members 27, the members 27 having a wire mesh grid 28 welded to their inner face. At two positions on each member 27, the member is drilled through and the hole formed is screw threaded to receive a respective clamping screw 29 having a hand wheel 30 at its outer end. The left hand tubular side member 27 as viewed in FIG. 3 is secured by jointing members 31 to two tubular sleeves 32 which surround the adjacent portion of the front hoop 19 whereby the frame of the door 26 is hingedly mounted on the front hoop 19. At the opposite side the frame side member 27 of the door 26 is provided with securing bolts 33 whereby it can be secured in a closed position, the free ends of the bolts 33 engaging in recesses in lugs 34 provided on the adjacent portions of the front hoop 19. Inner ends of the screw threaded members 29 are provided with heads 35 captive in recesses formed by brackets 36 and 37 on a glass reinforced plastics cover 38 having a profiled edge all round its periphery to engage with the seal 25. As can be seen at the sides of FIG. 4, the profiled edge of the cover 38 comprises an outer peripheral projection 39, the inner edge of which slides along the members 23 of the brackets 22 and an inner projection 40 which engages the seal 25. Thus by closing the door 26 formed by the frame members 27 and the cover 38 on the hinges 31, 32, and securing the bolts 33, 34, the cover 38 can be pressed into engagement with the seal 25 to seal the container by rotating hand wheels 30. FIGS. 3 and 4 show loop handles 41 to facilitate opening the door after the hand wheels 30 have been rotated to free the cover 38 from the seal and the bolts 33 have been retracted.

The radiused corners of the hoops 19 shown in FIGS. 1 and 3 provide that the container 1, if dropped, will tend to roll thereby reducing impact load on the particular corner.

Figure 5:
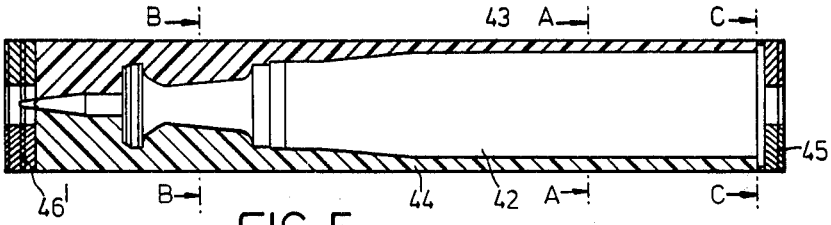
FIG. 5 is an elevation of a packing for a shell to be received in the storage and transport container for elongate articles of FIGS. 1 to 4.
Figure 6A:
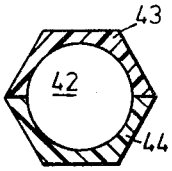
FIGS. 6A, 6B, and 6C are respectively sections taken on lines A—A, B—B, and C—C of FIG. 5.
Figure 6B:
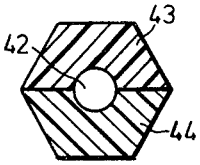
Figure 6C:
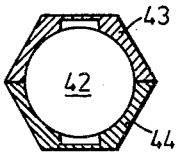

Referring to FIGS. 5 and 6, a shell for a tank gun is shown in outline at 42 with half mouldings of expanded polystyrene, shaped to the shell, surrounding it. The half mouldings are referenced 43 and 44. Protective end portions 45 and 46 are provided for the ends of the shell 42.

Figure 8A:
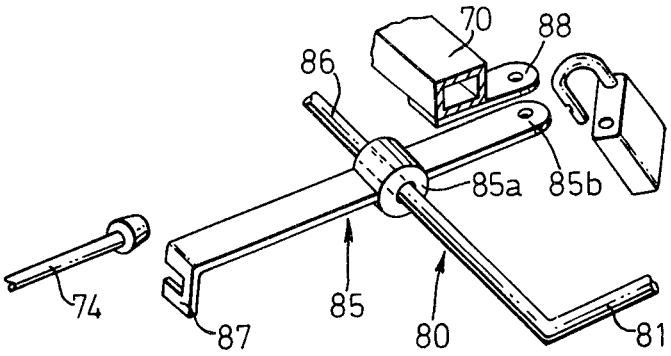
FIG. 8A is an exploded view showing a latch arrangement indicated by reference numeral 79 in FIG. 8.
Figure 8:
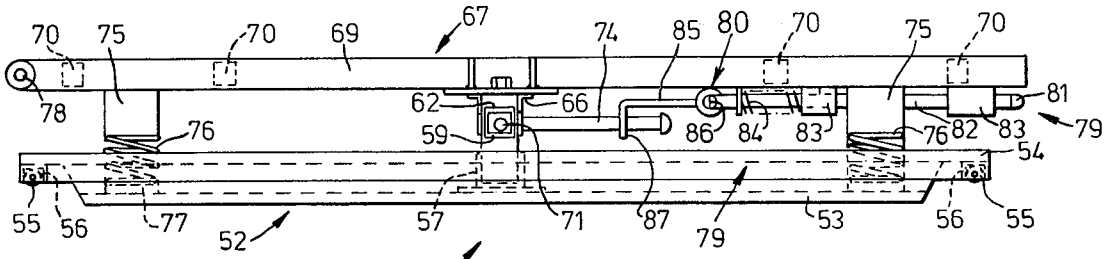
FIG. 8 is a view taken in the direction of arrow VIII of FIG. 7.
Figure 9:
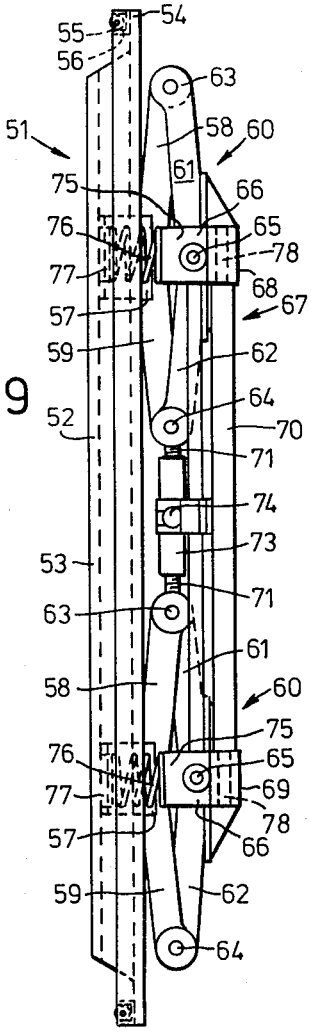
FIG. 9 is a view taken in the direction of arrow IX of FIG. 7.

Referring to FIGS. 7, 8, and 9, a door sealing arrangement comprises a door 51 formed as a rectangular sheet steel panel 52 with a central inwardly dished portion 53 and a peripheral flange 54 mounting a seal 55 comprising a silicone tube 15 millimeters in outside diameter. The seal 55 is held in place by a seal retaining channel 56. The panel 52, is pressed towards an opening in a container, will engage the container by means of the silicone seal 55 with the dished portion 53 projecting into the container to seal the container and maintain its seal so long as the panel 52 is pressed towards the container.

Secured on the outer face of the dished portion 53 of the panel 52 are a pair of U-shaped brackets 57, FIG. 8. By means of transverse pins, not visible in the drawings, extending between the two arms of the brackets 57, first and second levers 58 and 59 respectively of each of a pair of linkages 60 are pivotally mounted, the linkages 60 also comprising third and fourth levers 61 and 62 respectively. The lever 58 and 61 of each linkage are pivoted together by means of a pivot pin 63, the levers 59 and 62 of each linkage are pivoted together by means of a pivot pin 64 and the levers 61 and 62 of each linkage are pivoted together by means of a pivot pin 65 which also passes through a U-shaped bracket 66 of a framework 67. The framework 67 comprises a pair of main bars 68 and 69 interconnected by struts 70. The main bars 68 and 69 and the struts 70 are of rectangular section.

Each linkage 60 has a screw member 71 comprising a first portion engaged in a transverse screw threaded aperture in the pivot pin 64 and a second portion with an oppositely handed screw thread to the first portion engaged in a transverse screw threaded aperture in the pivot pin 63. The screw members 71 of the two linkages are secured together at their adjacent ends by welding them to a cylindrical member 73 having a transverse aperture therein at the midposition in its length. By rotating the cylindrical member 73 by means of a tommy bar 74 secured in the transverse aperture therein, the screw members 71 can be rotated to pull the pivot pins 63, 64 of each linkage 60 towards one another or by an opposite rotation to press them away from one another. Due to the parallelogram linkage 58, 59, 61, 62, of each scissor jack 60, relative movement towards or away from one another of the pivot pins 63, 64 will cause the panel 52 and the framework 67 to move towards or away from one another in opposite relation to the pivot pins 63, 64 of the linkages that is to say if the pivot pins 63, 64 move towards one another then the panel 52 and the framework 67 move away from one another and if the pivot pins 63, 64 move away from one another then the panel 52 and framework 67 move towards one another.

Mounted on the face of the framework which is towards the panel 52 are hollow cylindrical members 75 each of which has a respective coil spring 76 received therein. At their inner ends the coil springs 76 bear against a reinforcing and locating member 77 on the outer face of the depressed portion 53 of the panel 52. The force of the springs 76 tends to press the panel 52 and framework 67 away from one another.

At the left hand side of each of the members 68, 69, as viewed in FIG. 7, a transverse bore 78 is provided, each to engage on a respective hinge pin provided on the container. At the opposite end of each main member 68, 69 of the framework 67, a latch arrangement 79 is provided including a U-shaped sliding bolt 80 the free ends 81 of which can engage in apertures provided in projections from the container such that by means of the hinge pins and the sliding bolt 80, the framework 67 can be secured against outward movement with respect to the container. The arms 83 of the sliding bolt 80 are slidably mounted in bores in blocks 83 carried by the main members 68, 69 of the framework 67 and are biassed by biassing springs 84.

As shown in FIG. 8A, the bracket 85 includes a tubular portion 85A by means of which the bracket 85 is rotatably and slidably mounted on the transverse bar 86 of the U-shaped bolt 80. The bracket 85 has an end portion 87 with a slot in one side thereof, in which slot the tommy bar 74 of the linkages 60 can be engaged. By securing the opposite end 85B of the bracket 85 to a lug 88 on the adjacent strut 70 by means of a padlock, disengagement of the bracket 85 from the tommy bar 74 can be prevented thereby to prevent opening of the container by unauthorized persons. Thus the padlock prevents the bracket 85 from rotating or sliding on the transverse bar 86 of the U-shaped bolt 80, prevents the tommy bar 74 from being disengaged from the slot in the end portion 87 of the bracket 85 and also prevents the bolt 80 from being moved, by the springs 84, in a direction to release the free ends 81 of the bolt 80 from the apertures in projections from the container.

When the container is to be opened however it is merely necessary to unlock and remove the padlock, rotate and then slide the bracket 85 on the transverse bar 86 to free the tommy bar 74 from the bracket 85, effect one half turn of the screws 71 by means of the tommy bar 74 to pull the door panel 52 outwardly to break the seal, release the sliding bolt 80, swing the door 51 open and lift it off its hinges. This can be effected in only three to four seconds.

Stacking lugs may be provided on the container together with slinging points to facilitate crane transportation.

The container 1 can be of 1071 millimeters overall depth, 1041 millimeters overall width, 1200 millimeters overall length and together with its door may have a weight of approximately 275 kilos.

It can protect the contents stored therein from physical, environmental and biological damage and it is intended that it should be able to do so for a period of at least fifteen years.

I wish it to be understood that I do not consider the invention limited to the precise details of structure shown and set forth in this specification, for obvious modifications will occur to those skilled in the art to which the invention pertains.

I claim:

1. A storage and transport container for elongate articles comprising: a member of generally honeycomb section defining a plurality of elongate recesses, five walls forming a parallelipipedal box with one open side and surrounding said member of honeycomb section, spacer members secured to the outer faces of said side walls, tie bars secured to said spacer members, protective hoops encircling said box and secured to said tie bars so that each tie bar extends between an adjacent pair of said hoops; and a door serving to close and seal said open side of said box; said spacer members being of elongate configuration, each of top hat section with two flanges forming a brim of the top hat section welded to said walls of said box; said tie bars extending perpendicularly to said elongate spacer members and to said hoops, with a middle portion of each of said tie bars welded to a web of the respective top hat section spacer member which forms a crown thereof and with the ends of each tie bar welded to respective ones of two adjacent ones of said hoops.

2. The storage and transport container claimed in claim 1, wherein said open side of said box is at one end thereof and said hoops include an end hoop at said one end of said box and a further end hoop at an end of said box opposite to said one end with said end hoop and said further end hoop located at positions clear of said box; the wall of said box at said one end having a spacer member thereon to reinforce the end wall.

3. The storage and transport container claimed in claim 2, wherein said door comprises a surrounding frame, a wire mesh sheet at the inner side of said frame and a glass-reinforced plastic cover which engages a seal provided between said cover and said box at the open side thereof.

4. The storage and transport container claimed in claim 3, wherein said frame of said door at one of its sides is pivotally mounted on said end hoop, and at a side opposite to said one of its sides is provided with securing means.

5. The storage and transport container claimed in claim 4, including clamp screws threadedly engaged in apertures in said frame of said door and engaging said plastic cover at a plurality of positions around its periphery to press said plastic cover away from said frame and into engagement with said seal.

6. The storage and transport container claimed in claim 1, wherein said door comprises a panel with sealing means adjacent its periphery to engage said box adjacent said open side thereof, a framework located on the exterior face of said panel, at least one linkage located between and connecting said panel and said framework and a plurality of compression springs extending between said panel and said framework, said framework being engageable at opposite site sides thereof with said box such that the force springs presses said panel away from said framework toward said box, said linkage can be expanded to seal said panel around said open side of said box, and said linkage can be contracted to pull said panel outwardly toward said framework to break the seal.

7. The storage and transport container claimed in claim 6, wherein said linkage comprises a pair of parallelogram links with a common operating member.

8. The storage and transport container claimed in claim 7, wherein said framework is engageable with said box at one side by means of hinge pins and at an opposite side by means of a latch arrangement, and said latch arrangement and said common operating member of said links can be engaged each with the other and secured to prevent unauthorized opening of said container.

9. A storage and transport container for elongate articles comprising a member of generally honeycomb section defining a plurality of elongated recesses, five walls forming a parallelipipedal box surrounding said member of honeycomb section, elongated spacer members, each of top hat section with two base flanges forming a brim of said top hat section spot-welded to a wall of said box, said top hat section further comprising side flanges secured to said two base flanges and a crown flange secured to said side flanges; tie bars secured to said crown flanges of said spacer members, protective hoops encircling said box and secured to said tie bars, and a door to close and seal said open side of said box.

10. The storage and transport container claimed in claim 9, wherein said elongated spacer members encircle said box so that they extend parallel to said hoops with each of said spacer members located intermediate an adjacent pair of said hoops.

* * * * *